US008282257B2

(12) United States Patent
Rasmussen

(10) Patent No.: US 8,282,257 B2
(45) Date of Patent: Oct. 9, 2012

(54) PRESENTING DISPLAY OBJECTS IN A GAMING MACHINE

(75) Inventor: James M. Rasmussen, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 1303 days.

(21) Appl. No.: 11/572,879

(22) PCT Filed: Jul. 27, 2005

(86) PCT No.: PCT/US2005/026645

§ 371 (c)(1),
(2), (4) Date: Nov. 30, 2007

(87) PCT Pub. No.: WO2006/015046

PCT Pub. Date: Feb. 9, 2006

(65) Prior Publication Data

US 2008/0207303 A1 Aug. 28, 2008

Related U.S. Application Data

(60) Provisional application No. 60/592,309, filed on Jul. 29, 2004.

(51) Int. Cl.
*F21V 7/04* (2006.01)

(52) U.S. Cl. ..... 362/600; 362/26; 362/27; 362/615; 349/65; 349/67; 463/30; 463/34

(58) Field of Classification Search ..... 463/16, 463/20, 25, 30, 34; 345/102; 362/26, 600, 362/615, 603, 609, 27; 349/65, 67
See application file for complete search history.

(56) References Cited

U.S. PATENT DOCUMENTS

| | | | | |
|---|---|---|---|---|
| 5,010,672 | A | 4/1991 | Coleman | |
| 6,135,884 | A * | 10/2000 | Hedrick et al. | 463/20 |
| 6,811,273 | B2 * | 11/2004 | Satoh et al. | 362/27 |
| 6,937,298 | B2 * | 8/2005 | Okada | 349/58 |
| 7,219,893 | B2 * | 5/2007 | Tanimura et al. | 273/143 R |
| 7,220,181 | B2 * | 5/2007 | Okada | 463/32 |

(Continued)

FOREIGN PATENT DOCUMENTS

WO WO-03083564 A1 10/2003

(Continued)

OTHER PUBLICATIONS

"International Search Report for Application No. PCT/US2005/026645, date mailed Nov. 30, 2006", 4 pgs.

(Continued)

*Primary Examiner* — David L Lewis
*Assistant Examiner* — Chase Leichliter
(74) *Attorney, Agent, or Firm* — Schwegman Lundberg & Woessner, P.A.

(57) ABSTRACT

An apparatus for lighting display objects in a gaming machine is described herein. In one embodiment, a gaming machine includes a display object to be viewed and a light source to emit light. The gaming machine also includes a light-guiding panel. The light-guiding panel includes an edge to receive the light from the light source and a surface through which the light is reflected. In one embodiment, the surface includes a window through which the display object can be viewed. In one embodiment, the light is substantially uniformly reflected through all but the window of the surface.

12 Claims, 13 Drawing Sheets

U.S. PATENT DOCUMENTS

| | | | | |
|---|---|---|---|---|
| 7,267,471 | B2 * | 9/2007 | Torihara | 362/625 |
| 7,274,415 | B2 * | 9/2007 | Nakayoshi et al. | 349/65 |
| 7,295,263 | B2 * | 11/2007 | Shiraishi et al. | 349/67 |
| 7,892,094 | B2 * | 2/2011 | Tanimura et al. | 463/31 |
| 2002/0196388 | A1 * | 12/2002 | Ohkawa | 349/65 |
| 2003/0064799 | A1 * | 4/2003 | Goins et al. | 463/30 |
| 2004/0022050 | A1 * | 2/2004 | Yamashita et al. | 362/31 |
| 2004/0062025 | A1 | 4/2004 | Satoh et al. | |
| 2004/0224758 | A1 * | 11/2004 | Okada et al. | 463/31 |

FOREIGN PATENT DOCUMENTS

| | | |
|---|---|---|
| WO | WO-2006015046 A3 | 2/2006 |

OTHER PUBLICATIONS

"Written Opinion of the International Searching Authority for Application No. PCT/US2005/026645, date mailed Nov. 30, 2006", 6 pgs.

* cited by examiner

PRESENTING DISPLAY OBJECTS IN A GAMING MACHINE

RELATED APPLICATION

This application is a U.S. National Stage Filing under 35 U.S.C. 371 from International Patent Application Serial No. PCT/US2005/026645, filed Jul. 27, 2005, and published on Feb. 9, 2006 as WO 2006/015 A2, which claims the priority benefit of U.S. Provisional Application Ser. No. 60/592,309, filed Jul. 29, 2004, the contents of which are incorporated herein by reference.

LIMITED COPYRIGHT WAIVER

A portion of the disclosure of this patent document contains material to which the claim of copyright protection is made. The copyright owner has no objection to the facsimile reproduction by any person of the patent document or the patent disclosure, as it appears in the U.S. Patent and Trademark Office file or records, but reserves all other rights whatsoever.

FIELD

This invention relates generally to the field of gaming machines and more particularly to presenting display objects of a gaming machine.

BACKGROUND

As the casino gaming industry becomes more competitive, game makers strive to offer more attractive gaming machines. Typically, gaming machines that provide bright and even lighting for display objects are more attractive than those with flat or insufficient lighting. For example, artwork appearing on gaming machine panels is typically more attractive when it is brightly and evenly lit. Similarly, a mechanical slot machine's reel symbols are easily seen with bright and even backlighting.

FIG. 1A is a perspective view of a prior art apparatus for lighting display objects in a gaming machine. The prior art apparatus 100 uses edgelighting to illuminate the display objects. In particular, the apparatus 100 positions a prior art light-guiding panel 102 adjacent to a light source 104 so light 108 can shine into an edge 106 of the panel 102. FIG. 1B is a side view of the prior art apparatus for lighting display objects in a gaming machine. Etchings 110 in the panel 102 and a reflective backing (not shown) reflect the light 108 approximately 90° through a front surface 112 of the panel 102. When a display object is placed in front of the panel 102, light reflected through the panel's front surface 112 illuminates the display object.

One disadvantage of the prior art light-guiding panel is that display objects cannot be clearly seen through the panel's reflective etchings or reflective backing sheet. Because display objects cannot be clearly seen through the panel, the prior art light-guiding panel is not suitable for placement in front of display objects.

SUMMARY

An apparatus for lighting display objects in a gaming machine is described herein. In one embodiment, a gaming machine includes a display object to be viewed and a light source to emit light. The gaming machine also includes a light-guiding panel. The light-guiding panel includes an edge to receive the light from the light source and a surface through which the light is reflected. In one embodiment, the surface includes a window through which the display object can be viewed. In one embodiment, the light is substantially uniformly reflected through all but the window of the surface.

In one embodiment, the gaming machine includes a display object, a light source to emit light, and a light-guiding panel. In an embodiment, the light-guiding panel includes an edge to receive the light from the light source. The light-guiding panel also includes a back surface that includes an etched portion that includes fine recesses for reflecting the light. The back surface also includes a transparent non-etched portion through which the display object can be viewed and a transparent front surface through which the light is reflected.

BRIEF DESCRIPTION OF THE FIGURES

The present invention is illustrated by way of example and not limitation in the Figures of the accompanying drawings in which.

DESCRIPTION OF THE EMBODIMENTS

Methods and apparatus for presenting display objects in a gaming machine are described herein. In the following description, numerous specific details are set forth. However, it is understood that embodiments of the invention may be practiced without these specific details. In other instances, well-known circuits, structures and techniques have not been shown in detail in order not to obscure the understanding of this description. Note that in this description, references to "one embodiment" or "an embodiment" mean that the feature being referred to is included in at least one embodiment of the invention. Further, separate references to "one embodiment" in this description do not necessarily refer to the same embodiment; however, neither are such embodiments mutually exclusive, unless so stated and except as will be readily apparent to those of ordinary skill in the art. Thus, the present invention can include any variety of combinations and/or integrations of the embodiments described herein. Moreover, in this description, the phrase "exemplary embodiment" means that the embodiment being referred to serves as an example or illustration.

This description of the embodiments is divided into two sections. In the first section, exemplary embodiments of the invention are described. In the second section, and exemplary gaming machine is described.

Exemplary Embodiments

As described above (see Background section), eliminating shadows from a light-guiding panel has thus far been a difficult task. However, according to embodiments of the invention, shadows can be eliminated from a light-guiding panel with cutouts by surrounding the panel with a light source.

Figure 1A:
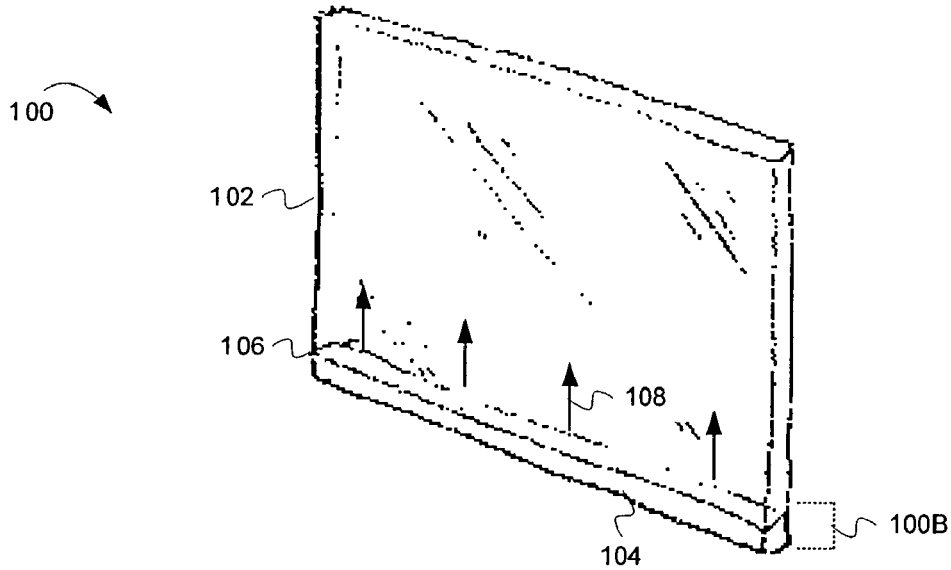
FIG. 1A (PRIOR ART)
FIG. 1A is a perspective view of a prior art apparatus for lighting display objects in a gaming machine.
Figure 1B:
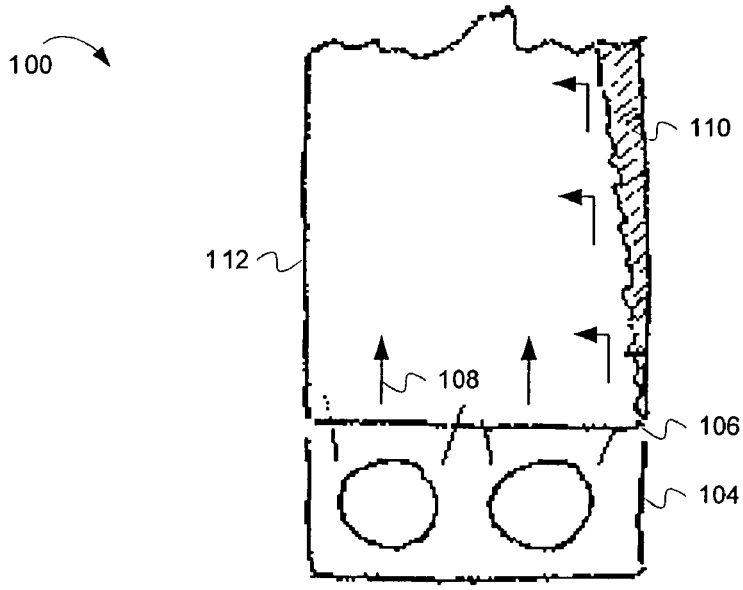
FIG. 1B (PRIOR ART)
FIG. 1B is a side view of the prior art apparatus for lighting display objects in a gaming machine.
Figure 2:
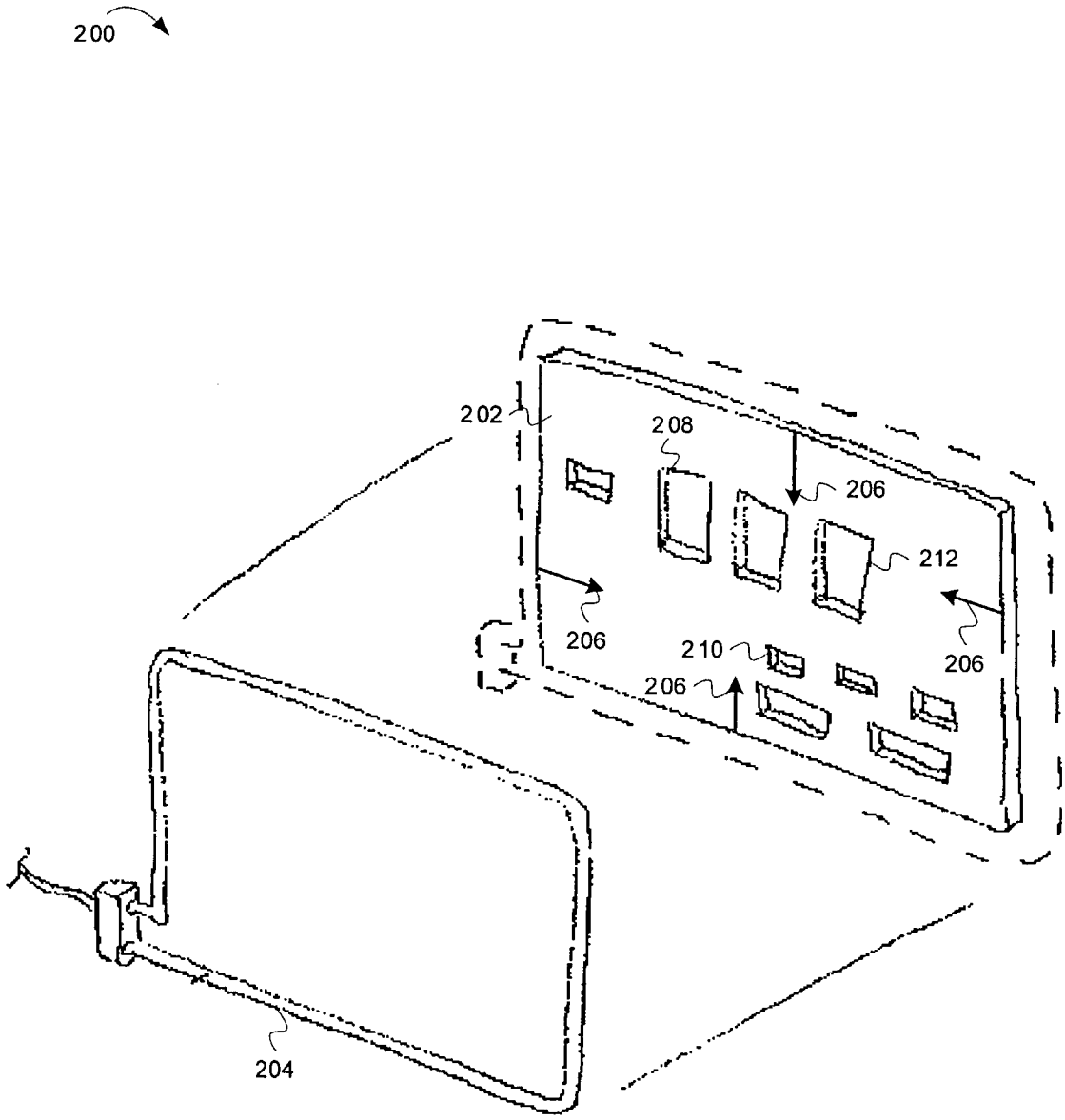
FIG. 2 is a perspective view of a light source surrounding a light-guiding panel with cutouts, according to exemplary embodiments of the invention.

FIG. 2 is a perspective view of a light source surrounding a light-guiding panel with cutouts, according to exemplary embodiments of the invention. As shown in FIG. 2, a light-guiding panel 202 includes a number of cutouts (see 208, 210, and 212). Moreover, some of the cutouts "overlap" each other (see 210 and 212). A light source 204 is placed around the light-guiding panel 202 to provide light 206 from all sides of the panel 202. According to embodiments, the light source 204 can be a cold-cathode fluorescent light (CCFL), a set of one or more light emitting diodes (LEDs), or other suitable light sources. In one embodiment, there is a reflective backing (not shown) coupled to one side of the panel 202.

Because the light source 204 provides light from all sides of the panel 202, the panel 202 can receive and emit the light 206 while minimizing shadowing within the panel 202. In one embodiment, display objects, such as slot machine reels, artwork, silkscreen glass, insertable legend panels (e.g., pay tables), and/or light emitting diode display indicators can be placed in the cutouts. When the light passes into a cutout, it is disbursed in several directions, as described above. The disbursed light illuminates any display objects placed within the cutouts.

Figure 3:
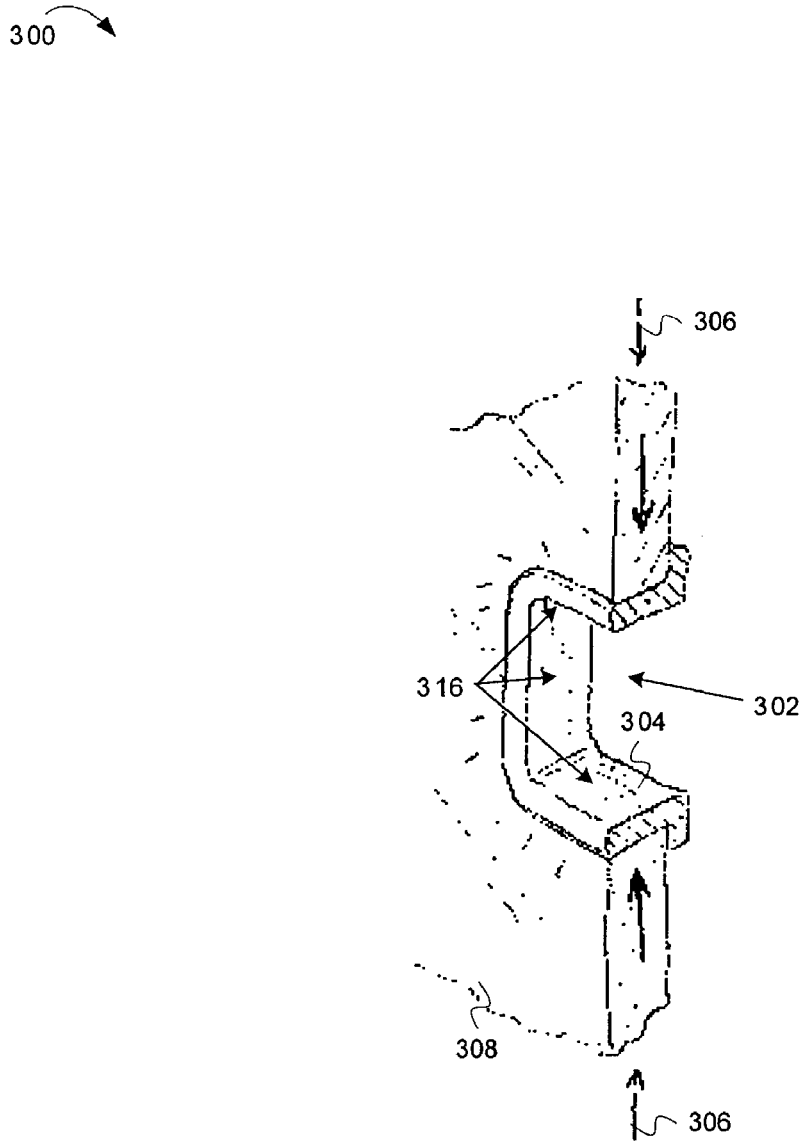
FIG. 3 is a cutaway view of a portion of a light-guiding panel of a gaming machine, according to exemplary embodiments of the invention.

Another technique for presenting display objects in cutouts of a light-guiding panel calls for applying opaque material to edges of the cutouts. FIG. 3 is a cutaway view of a portion of a light-guiding panel of a gaming machine, according to exemplary embodiments of the invention. The light-guiding panel 308 of FIG. 3 includes a cutout 302, which has edges 316. The edges 316 are covered with an opaque material 304, such as an opaque paint or grommet. In one embodiment, the grommet can be constructed from a translucent material, such as plastic. One or more of the grommet's inner surfaces can be coated with tape, paint, or other suitable opaque material.

In FIG. 3, light 306 flows into the light-guiding panel 308 from the panel's top and bottom edges. One or more light sources can provide the light 306. As the light 306 hits the opaque material 304, it is redirected away from the cutout 302. In one embodiment, the redirected light causes the grommet to glow. The opaque material 304 substantially blocks the light 306 from flowing into the cutout 302. As a result, the light 306 does not substantially illuminate display objects presented in the cutout 302. Eliminating substantial light flow into the cutout 302 allows self-lit display objects (e.g., LED display indicators) to appear brightly and clearly.

Figure 4:
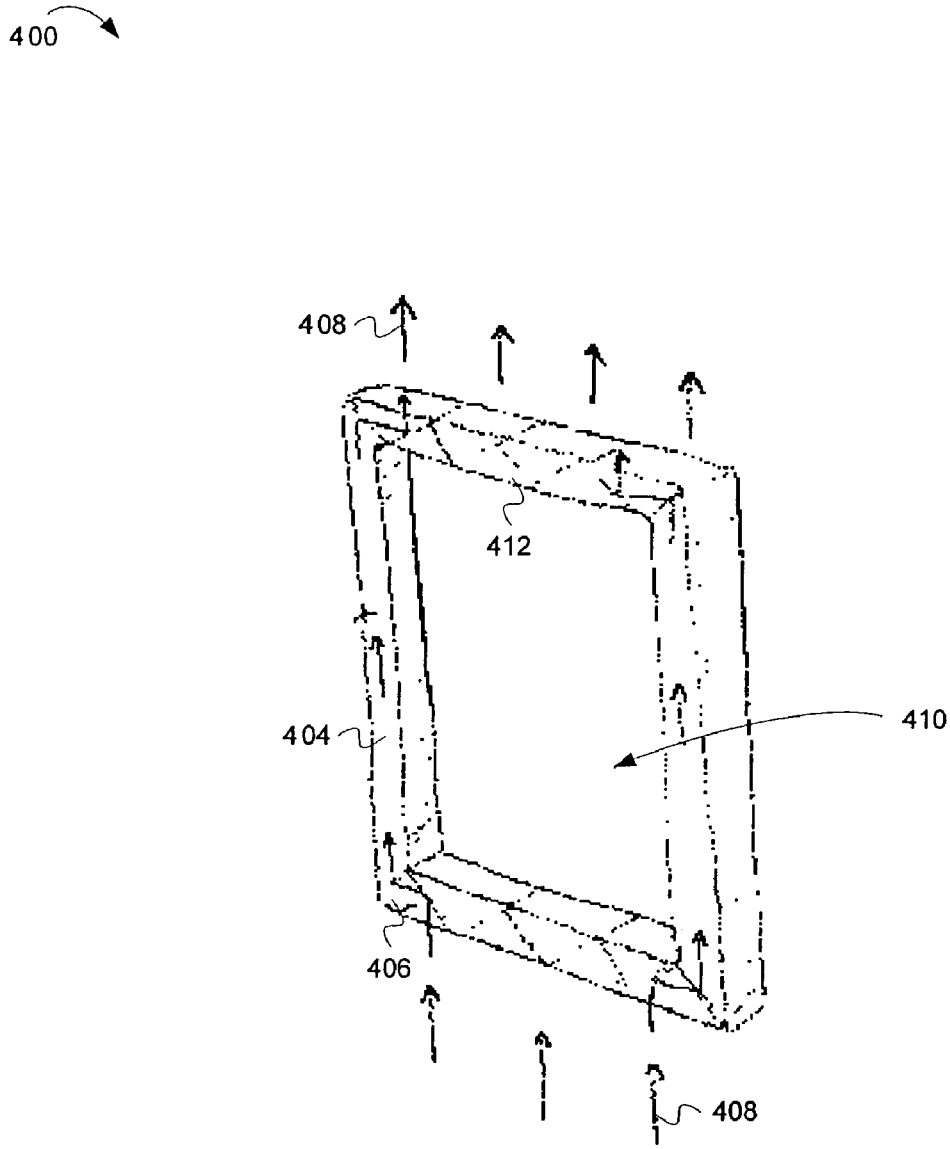
FIG. 4 illustrates a technique for using prisms to redirect light around a cutout in a light-guiding panel of a gaming machine, according to exemplary embodiments of the invention.

According to an alternative embodiment, prisms can be used to direct light around a cutout. FIG. 4 illustrates a technique for using prisms to redirect light around a cutout in a light-guiding panel of a gaming machine, according to exemplary embodiments of the invention. FIG. 4 shows a portion of a light-guiding panel 404 with a cutout 410. The light-guiding panel 404 includes a first set of prisms 406 for redirecting light around the cutout 410 and a second set of prisms 412 for directing the light through the panel 404. In one embodiment, to aid in directing light, lenses can be used in concert with the prisms 406. As shown in FIG. 4, light 408 travels through the light-guiding panel 404 into the first set of prisms 406, which redirect the light 408 around the cutout 410. After being redirected around the cutout 410, the light 408 travels past the cutout 410 and through the second set of prisms 412. The second set of prisms 412 directs the light 408 through any remaining portion of the panel 404. In an alternative embodiment, there are light sources above and below the panel 404. As a result, both the first and second set of prisms receive light and transmit the light through the panel 404. As described above, when light from an edgelighting source is prohibited from entering a cutout, self-lit display objects appear brightly and clearly in the cutout.

Figure 5:
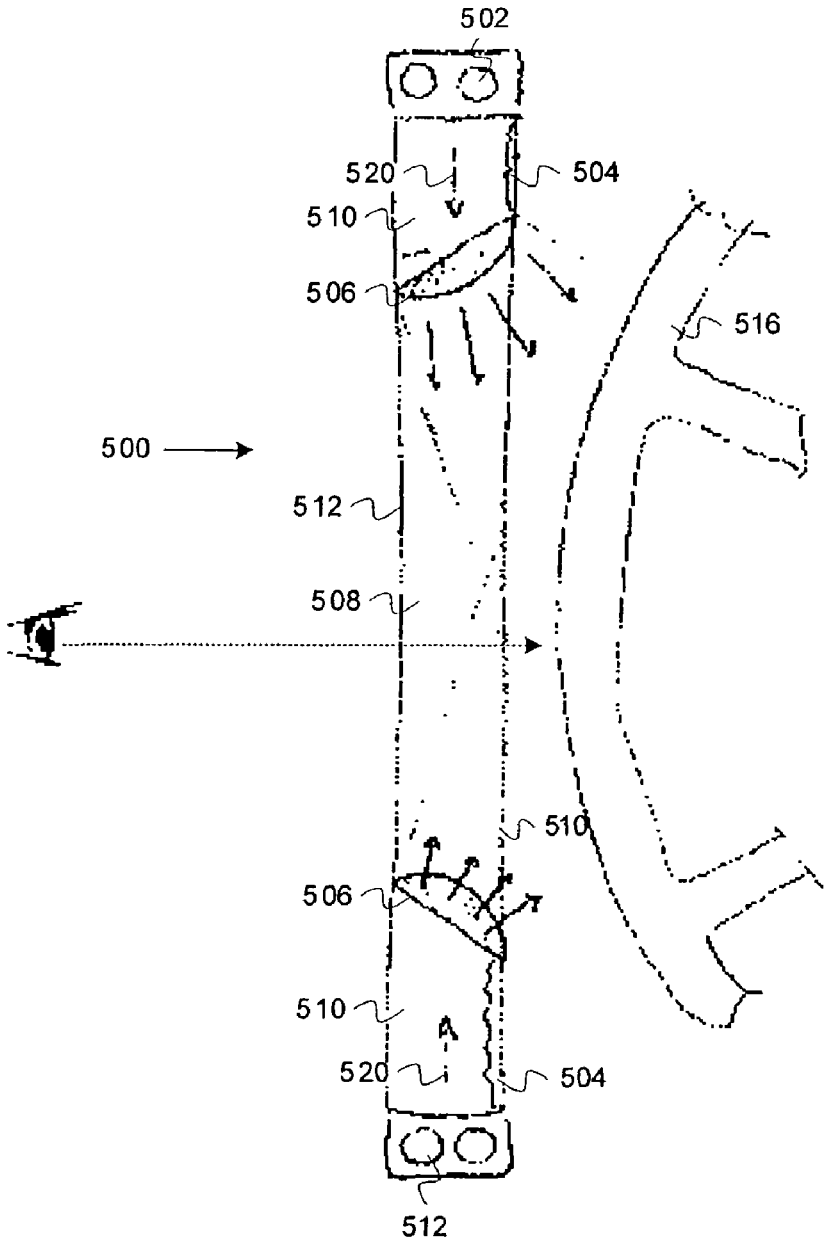
FIG. 5 is a light-guiding panel with lenses for focusing light on a display object, according to exemplary embodiments of the invention.

In yet another embodiment, instead of blocking light from entering a window, light is redirected into the window. FIG. 5 is a light-guiding panel with lenses for focusing light on a display object, according to exemplary embodiments of the invention. As shown in FIG. 5, a light-guiding panel 500 has a front surface 512 and aback surface 510. Light sources 502 and 512 are coupled to edges of the panel 500. The panel 500 also includes reflectors 504, which redirect light through the front surface 512. In one embodiment, the reflectors 504 are etched into the panel's back surface 510. The panel 500 also includes a window 508 through which display objects can be seen. In one embodiment, the window 508 is a cutout. Alternatively, the window can be a transparent section of the panel 500. In either instance, display objects can be clearly viewed through the window 508. The panel 500 also includes lenses 506, which redirect and focus light on a display object 516.

In FIG. 5, the panel 500 receives light 520 from light sources 502 and 512. In particular, the light-guiding panel's edges receive the light 520. The light passes over the reflectors 504, which redirect some of the light 520 through the front surface 512. The remaining light passes into the lenses 506, which focus the light on a display object 516, which is placed behind the window. As a result, when placed in front of a display object 516, the lenses 506 of the edge-lit light-guiding panel 500 can focus light on the display object.

Figure 6:
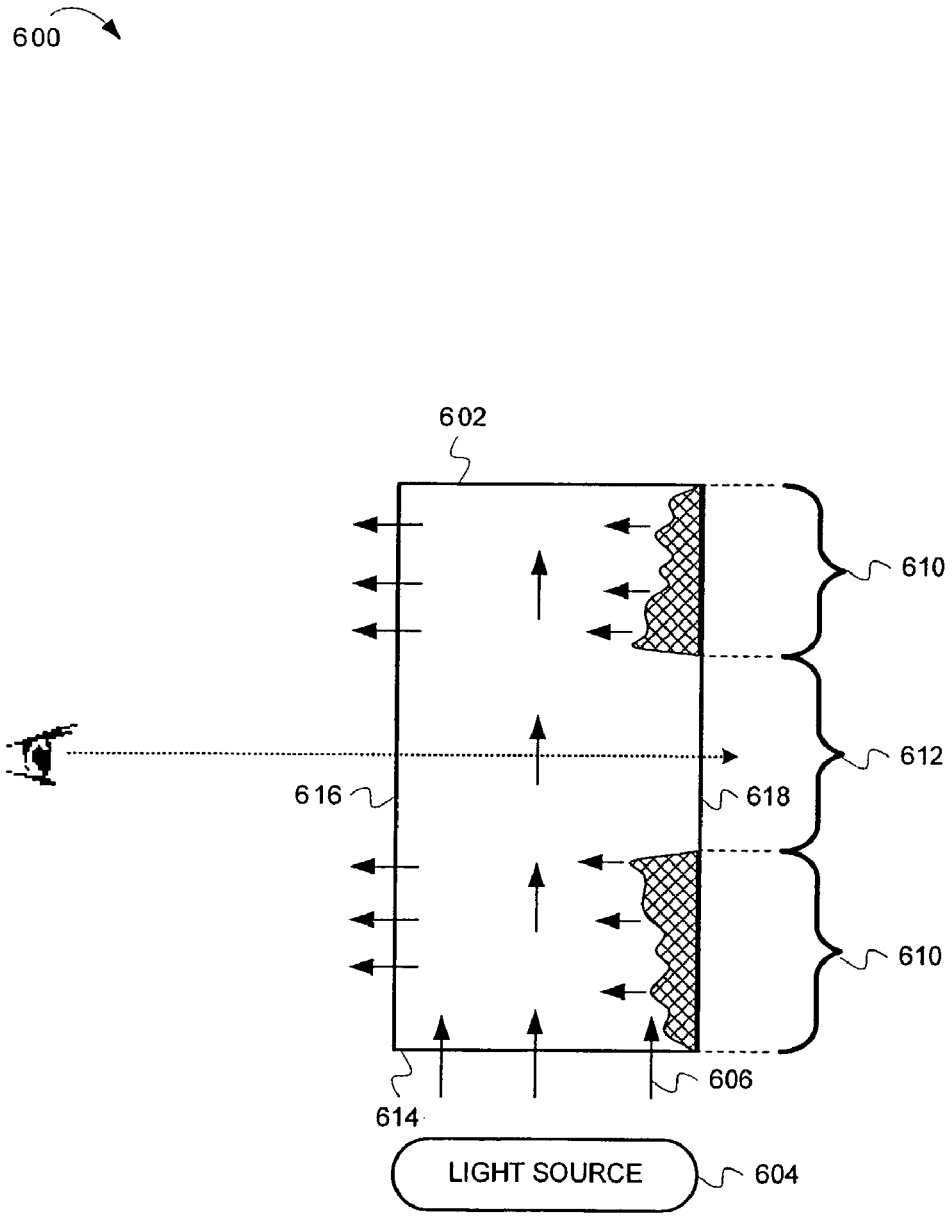
FIG. 6 illustrates a light-guiding panel with reflectors for redirecting edge lighting, according to exemplary embodiments of the invention.

While the discussion of FIGS. 2-5 focused primarily on presenting display objects inside a cutout, FIG. 6 describes a technique for illuminating display objects by placing an edge-lit light-guiding panel over the display objects.

FIG. 6 illustrates a light-guiding panel with reflectors for redirecting edge lighting, according to exemplary embodiments of the invention. As shown in FIG. 6, a light-guiding panel 602 has a front surface 616 and a back surface 618. The light-guiding panel 602 includes reflectors 610 and a window 612. In one embodiment, the reflectors 610 are formed by etching numerous recesses into the back surface 618 of the light-guiding panel 602. The etchings can be progressively laid across the panel 602 to evenly distribute light 606 as it travels away from a light source 604. That is, there can be progressively more etchings and/or deeper etchings in parts of the panel 602 to evenly distribute the light across the panel.

The window 612 is a portion of the panel 602 that does not include reflectors. The window 612 is transparent so display objects can be seen clearly through it. The etched portions of the back surface 618 are not transparent, so display objects cannot be clearly seen through those parts of the back surface 618.

As shown in FIG. 6, the panel's edge 614 receives the light 606 from the light source 604. As the light 606 travels through the panel 602, it hits the reflectors 610, which reflect the light approximately 90° through the front surface 616 of the panel 602. According to embodiments, display objects placed behind the window 612 are clearly visible and appear to be "glowing" because of the reflected light.

Figure 7:
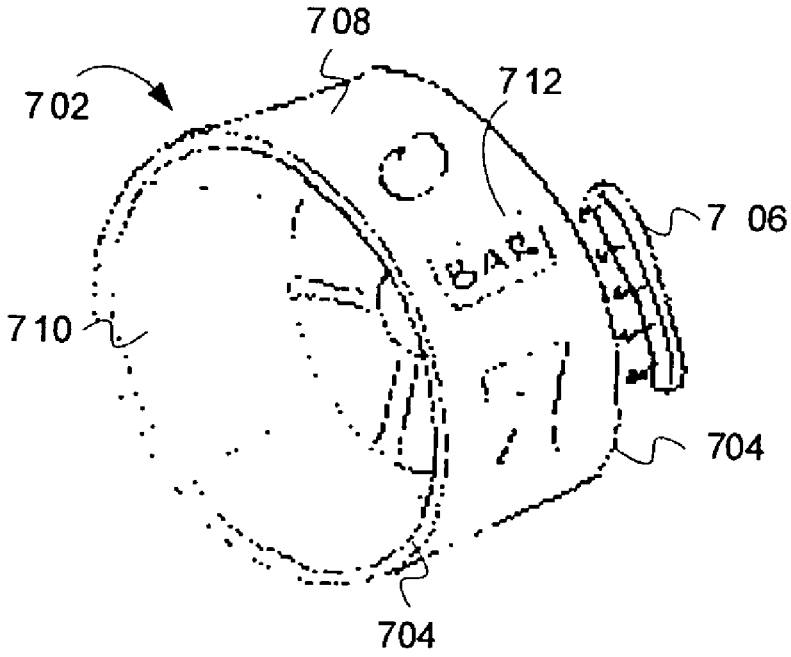
FIG. 7 illustrates a slot machine reel that includes a light-guiding drum, according to embodiments of the invention.
Figure 8:
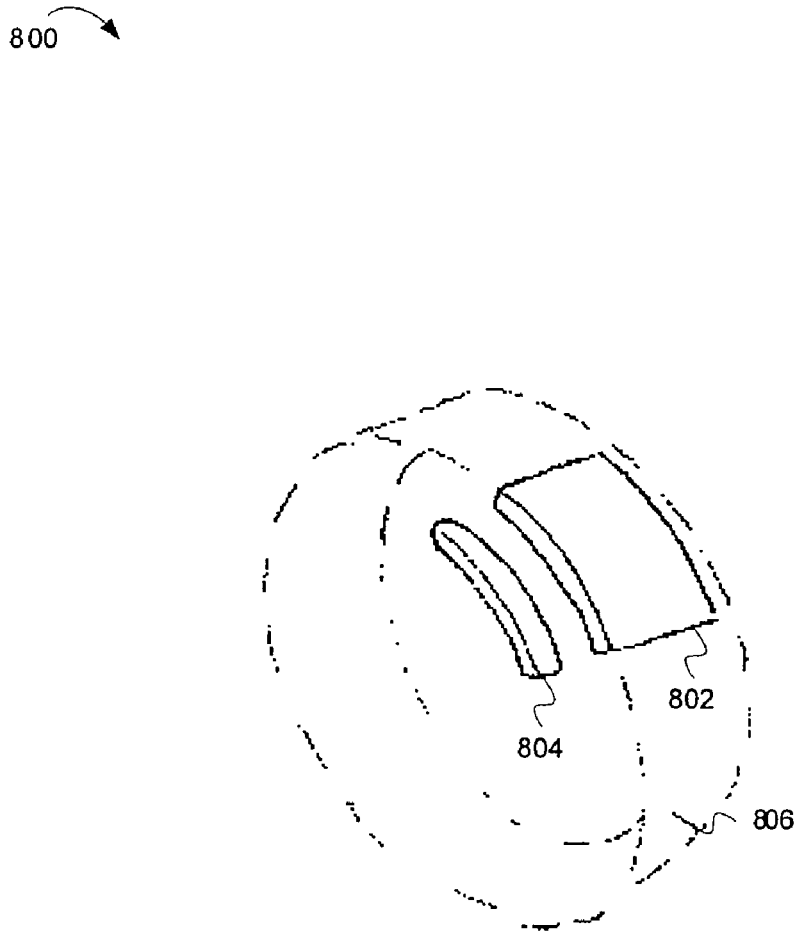
FIG. 8 illustrates a slot machine reel coupled with an arcuate light-guiding panel, according to exemplary embodiments of the invention.
Figure 9:
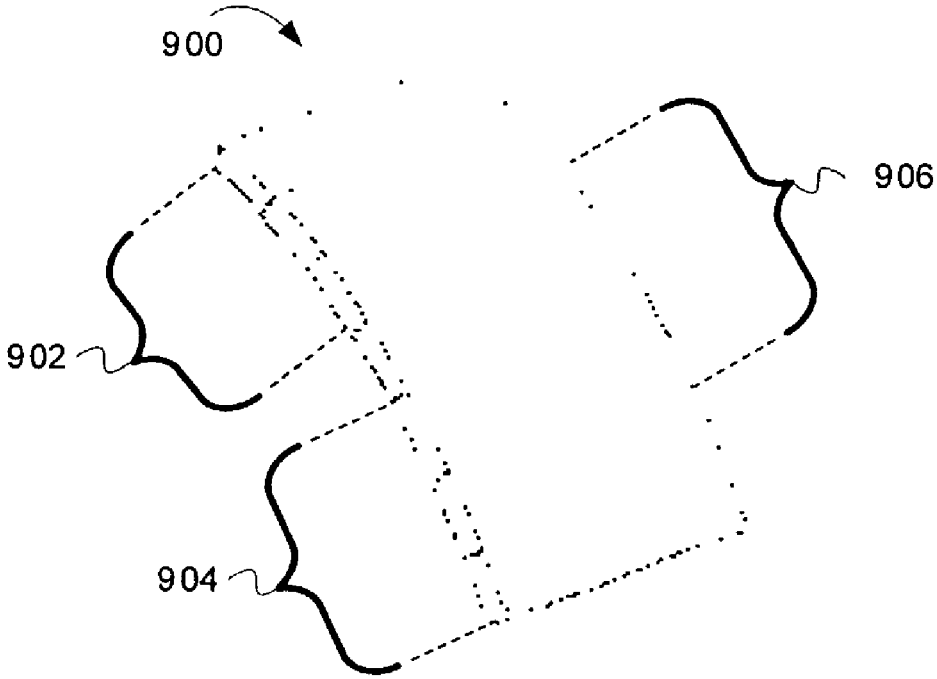
FIG. 9 illustrates light-guiding panels used for backlighting reel strips, according to embodiments of the invention.

FIGS. 7-9 describe embodiments of the invention that use an edge-lit light-guiding panel to illuminate reel symbols on a slot machine reel. FIG. 7 illustrates a slot machine reel that includes a light-guiding drum, according to embodiments of the invention. In FIG. 7, a light-guiding drum 702 has edges 704, which can receive light from a light source 706. The light-guiding drum 702 also includes an inside surface 710 and an outside surface 708. The inside surface 710 includes reflectors (e.g., reflective etchings; see the description of reflectors above) to reflect light received from the light source 706 through the outside surface 708. A reel strip can overlay the outside surface 708 of the light-guiding drum 702. In one embodiment, the reel strip includes reel symbols 712. In the embodiment shown in FIG. 7, light from the light source 706 passes into an edge 704 of the drum 702 and hits the reflectors of the inside surface 710. The reflectors redirect the light through the outside surface 708. The redirected light illuminates the reel strip (i.e., the reel strip is backlit by the redirected light). In one embodiment, the light source 706 is an arcuate CCFL, while in alternative embodiments it can be one or more LEDs or incandescent bulbs. In one embodiment the light source is controllable (e.g., turning light on/off is controllable and brightness is controllable), allowing for lighting effects.

Although the entire reel drum of FIG. 7 is constructed of light-guiding material, other embodiments call for an arcuate light-guiding panel used in concert with a reel drum. FIG. 8 illustrates a slot machine reel coupled with an arcuate light-guiding panel, according to exemplary embodiments of the invention. As shown in FIG. 8, an arcuate light-guiding panel 802 is mounted inside a reel drum 806. The reel drum 806 can be transparent or translucent. A light source 804 is mounted adjacent to the arcuate light-guiding panel 802. Light from the light source 804 enters the arcuate light-guiding panel 802 and is reflected through a top surface of the panel by reflectors etched into a bottom surface of the panel 802. The reflected light shines through the reel drum 806 and backlights a reel strip mounted on the reel drum 806.

Instead of the arcuate light-guiding panel of FIG. 8, one embodiment calls for a series of smaller light-guiding panels used in concert with a plurality of light sources. FIG. 9 illustrates light-guiding panels used for backlighting reel strips, according to embodiments of the invention. As shown in FIG. 9, several light-guiding panels 900 can be coupled together to provide backlighting to a slot machine reel strip. One or more light sources can be employed to light different ones of the panels 900. For example, one light source can light the panels 902, while a different light source can light the panels 906. Yet another light source can light the panels 904. The panels 900 include reflectors to redirect light, as described above. Thus, the panels can be used to backlight reel symbols. In one embodiment, an opaque material separates each panel of the panel group 902. As a result, with controlled lighting, any combination of panels of the panel group 902 can be lit. In one embodiment all panel groups 902, 904, and 906 can be configured this way, allowing any combination of panels 900 to be lit. In one embodiment, different light sources provide light to different panels depending on which reel symbols should be lit. Embodiments call for any suitable number of panels and light sources.

In certain of the embodiments described above, the light sources can be LEDs, incandescent lamps, halogen lamps, sunlight, or cold cathode fluorescent lamps (CCFLs). The light sources can emit light of different colors and employ any suitable technique emitting colored light. For example, filters can be placed over white light or colored light sources. As another example, a light source can use three CCFLs of the primary colors (Red, Green, and Blue) to create colored lighting. Embodiments can use of three CCFLs in the primary colors, where the CCFLs are intensity controlled to create a rainbow of colors. Mixing light intensities will produce a full spectrum of color or a limited set of colors beyond just the primary colors. In one embodiment, the lamps can be controlled from three separate CCFL inverters or a single inverter design that allows for individual lamp control. The control to the inverter(s) can be as simple as an ON/OFF switch for each lamp or a variable intensity control. Intensity can be controlled via a multitude of input signal methods (examples; Voltage control, Pulse width modulation, etc).

Coupling Film to the Panel and Other Gaming Machine Surfaces

The foregoing section describes using a light-guiding panel for manipulating light in a gaming machine. However, this section describes techniques for modifying the appearance of a gaming machine by coupling art film or other film to a light-guiding panel or other gaming machine surface. In particular, FIG. 10 shows a technique for applying film to a gaming machine surface, while FIGS. 11 and 12 describe methods for applying/removing films to/from a gaming machine.

Figure 10:
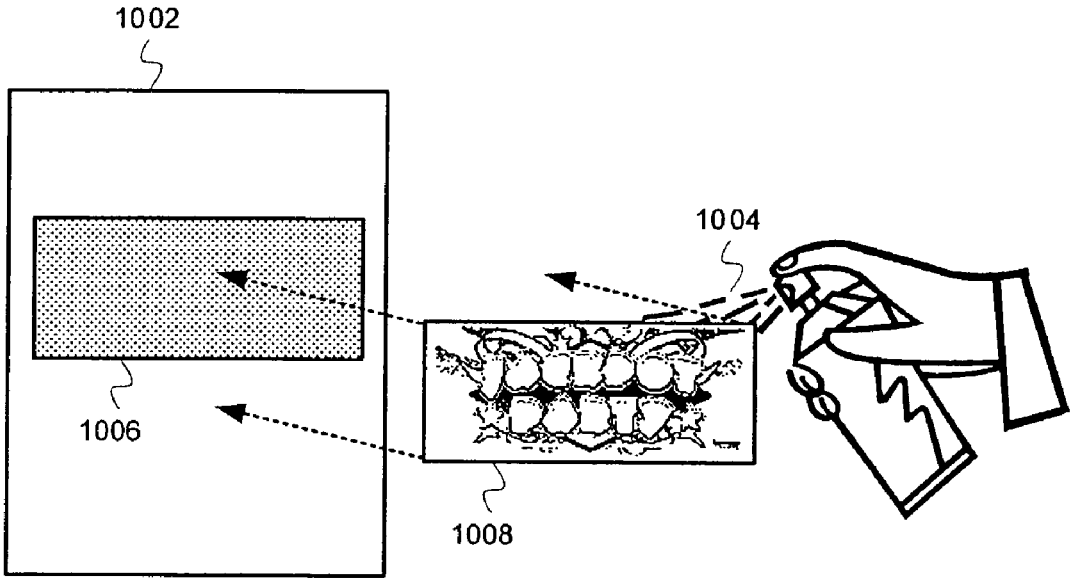
FIG. 10 illustrates a technique for attaching a film to a gaming machine surface with clean-release adhesive.

FIG. 10 illustrates a technique for attaching a film to a gaming machine surface with clean-release adhesive. FIG. 10 shows a gaming machine surface 1002 prepared for receiving a film 1008. In one embodiment, the film 1008 is art film, which includes artwork and/or game legends (e.g., pay tables) related to a casino style game. Alternately, the film 1008 can be optical film for creating lighting effects on the gaming machine. For example, optical film can be placed over a light guiding panel (see description above) for additional optical effects. The optical film can be Color Dotmation film coupled to a glass panel, which overlays a display device (e.g., an LCD).

According to one embodiment, before applying the film 1008 to the gaming machine surface 1002, a clean-release adhesive 1004 is sprayed on a surface (back surface or front surface) of the film 1008. Alternatively, instead of applying the clean-release adhesive 1004 to the film 1008, the clean-release adhesive 1004 can be applied to a portion 1006 of the gaming machine surface 1002. After the clean-release adhesive 1004 is applied, the film 1008 is applied to the gaming machine surface 1002.

According to an alternative embodiment, the film 1008 can be made of cohesive material that adheres to gaming machine surfaces without additional adhesive. In an embodiment where the film 1008 is constructed from cohesive material, the film may be laminated to make it less stretchable and/or the film 1008 may be constructed from a non-stretchable material. Because the cohesive film can adhere to gaming machine surfaces without an adhesive, the cohesive film can be pressed onto gaming machine surfaces.

Figure 11:
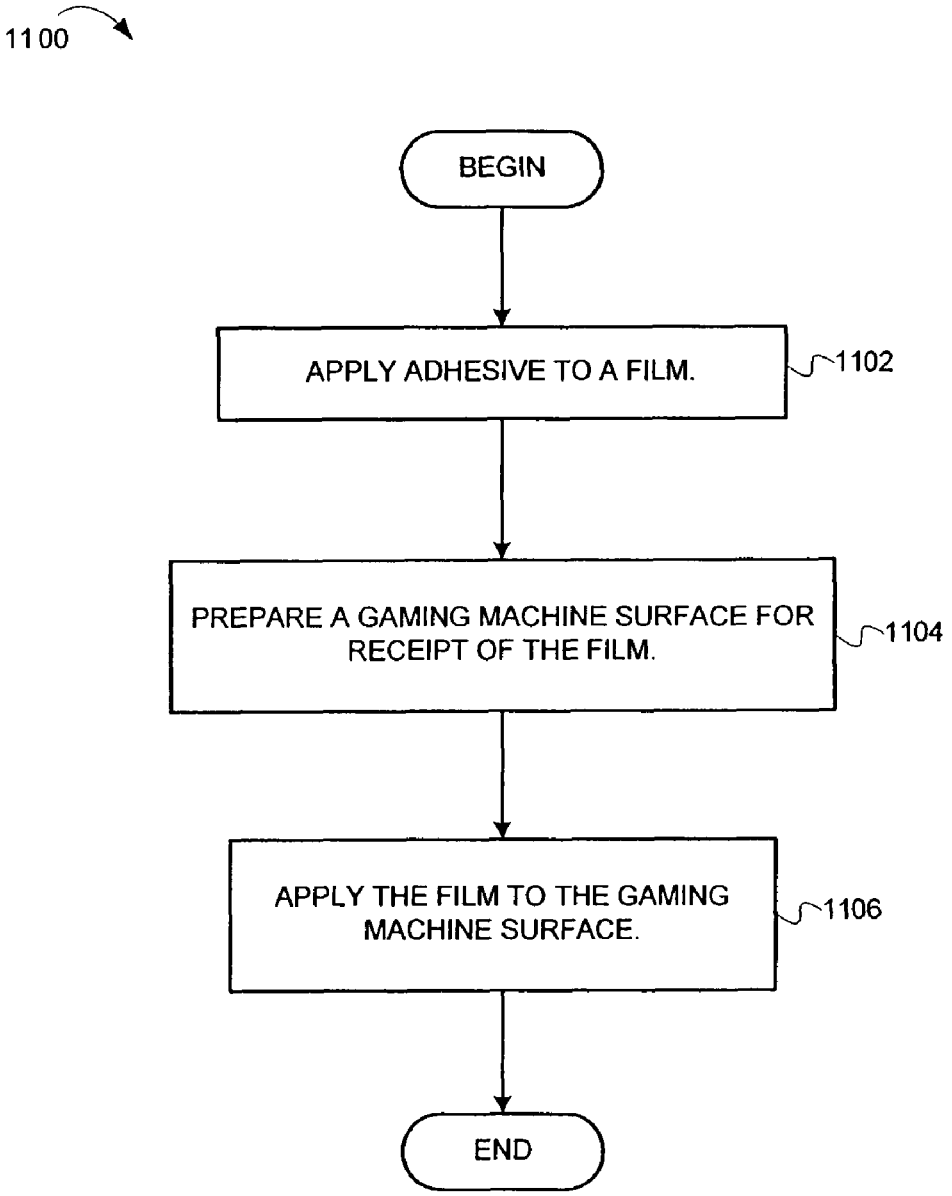
FIG. 11 is a flow diagram illustrating operations for applying a film to a gaming machine device surface.

FIG. 11 is a flow diagram illustrating operations for applying a film to a gaming machine device surface. The operations of the flow diagram 1100 will be described with reference to FIG. 10. The flow diagram 1100 commences at block 1102.

At block 1102, an adhesive is applied to a film. For example, a clean-release adhesive 1004 is applied to a film 1008. In one embodiment, the clean-release adhesive is 3M™ Remount™ Spray Adhesive. However, alternative embodiments call for any suitable clean-release adhesive. In one embodiment, the adhesive is non-opaque, so light can pass relatively uninterrupted through the adhesive. In an embodiment in which the adhesive 1004 is sprayed on the front surface of the film 1008, the adhesive 1004 is optically clear. In an embodiment in which the film 1008 is constructed from cohesive material, the operation at block 1102 can be skipped.

In one embodiment, the clean-release adhesive is sprayed onto the surface 1002. Alternatively, the clean-release adhesive can be rolled, poured, or screened onto the film 1008. As noted above, the film 1008 can be an art film (i.e., a film containing artwork) or any suitable optical film used for creating lighting and/or video effects on the gaming machine. The flow continues at block 1104.

At block 1104, a gaming machine surface 1002 is prepared for receipt of the film 1008. The preparation can include cleaning the gaming machine surface. In one embodiment, the surface 1002 is a non-porous glass located in front of a liquid crystal display or other display device. Alternatively, the surface 1002 can be a front panel (glass or plastic) of the gaming machine. Alternatively, the surface 1002 can be a light guiding panel. The flow continues at block 1106.

At block 1106, the film 1008 is applied to the gaming machine surface 1002. In one embodiment, the film 1008 is pressed onto the gaming machine surface 1002. The gaming machine surface can include lines or other markings (e.g., cross hairs) to indicate where film should be applied to the gaming machine surface. From block 1106, the flow ends.

Figure 12:
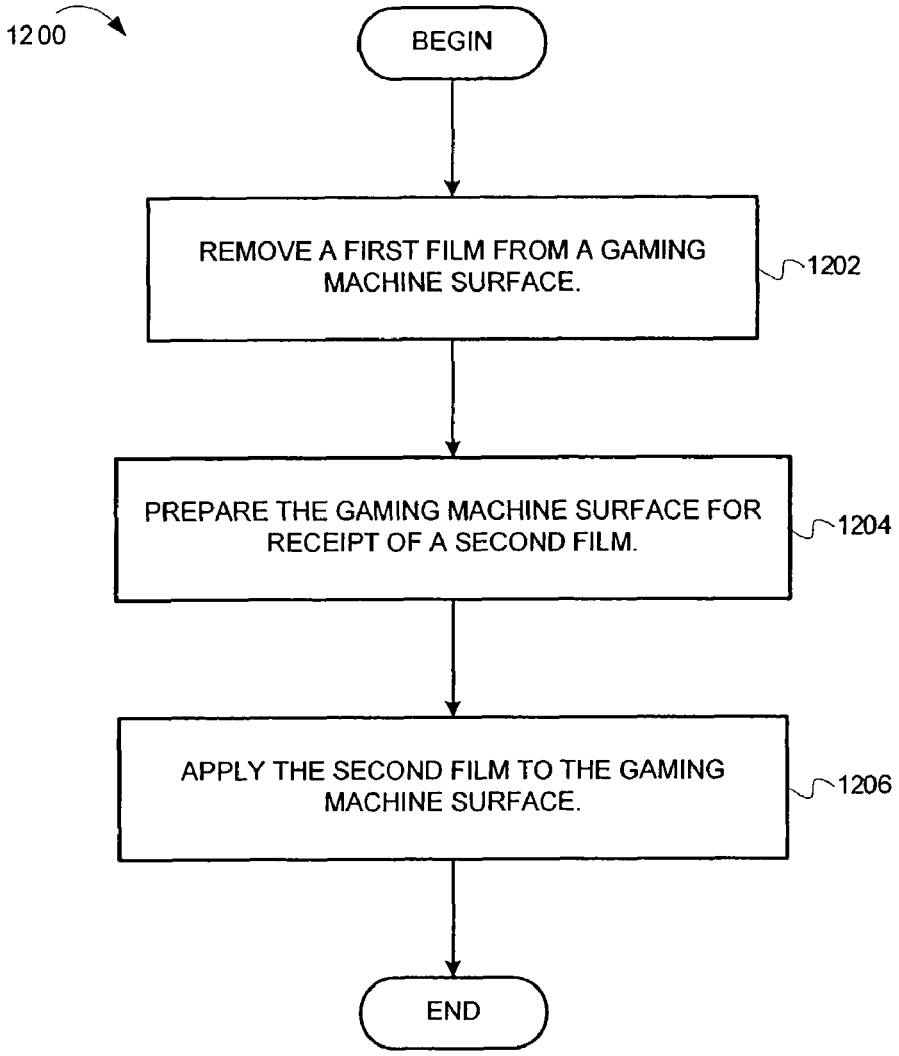
FIG. 12 illustrates a flow diagram for replacing films on a gaming machine.

FIG. 12 illustrates a flow diagram for replacing films on a gaming machine. The flow diagram 1200 will commence at block 1202. According to embodiments of the invention, a gaming machine attendant or other person can perform the operations of the flow diagram 1200.

At block 1202, a first film is removed from the gaming machine surface. In one embodiment, the first film can be cleanly peeled off the gaming machine with leaving any remnants. The flow continues at block 1204.

At block 1204, the gaming machine surface is prepared for a second adhesive-coated film. In one embodiment, the preparation includes cleaning the gaming machine surface. The flow continues at blocks 1206.

At block 1206, second film is applied to the gaming machine surface. In one embodiment, the second film is coated with a clean-release adhesive. In another embodiment, the second film is made from cohesive material, so no adhesive is needed. The gaming machine surface can include lines or other markings (e.g., cross hairs) to indicate where film should be applied to the gaming machine surface. From block 1206, the flow ends. The application and replacement methods of FIGS. 11 and 12 enable quick and easy installation and replacement of optical film, artwork, and legends (e.g., pay tables), etc. on gaming machines. For example, manufacturers can use the installation method to install artwork without any mechanical fasteners, while gaming machine attendants can replace the artwork using few or no tools.

Exemplary Gaming Machine

Figure 13:
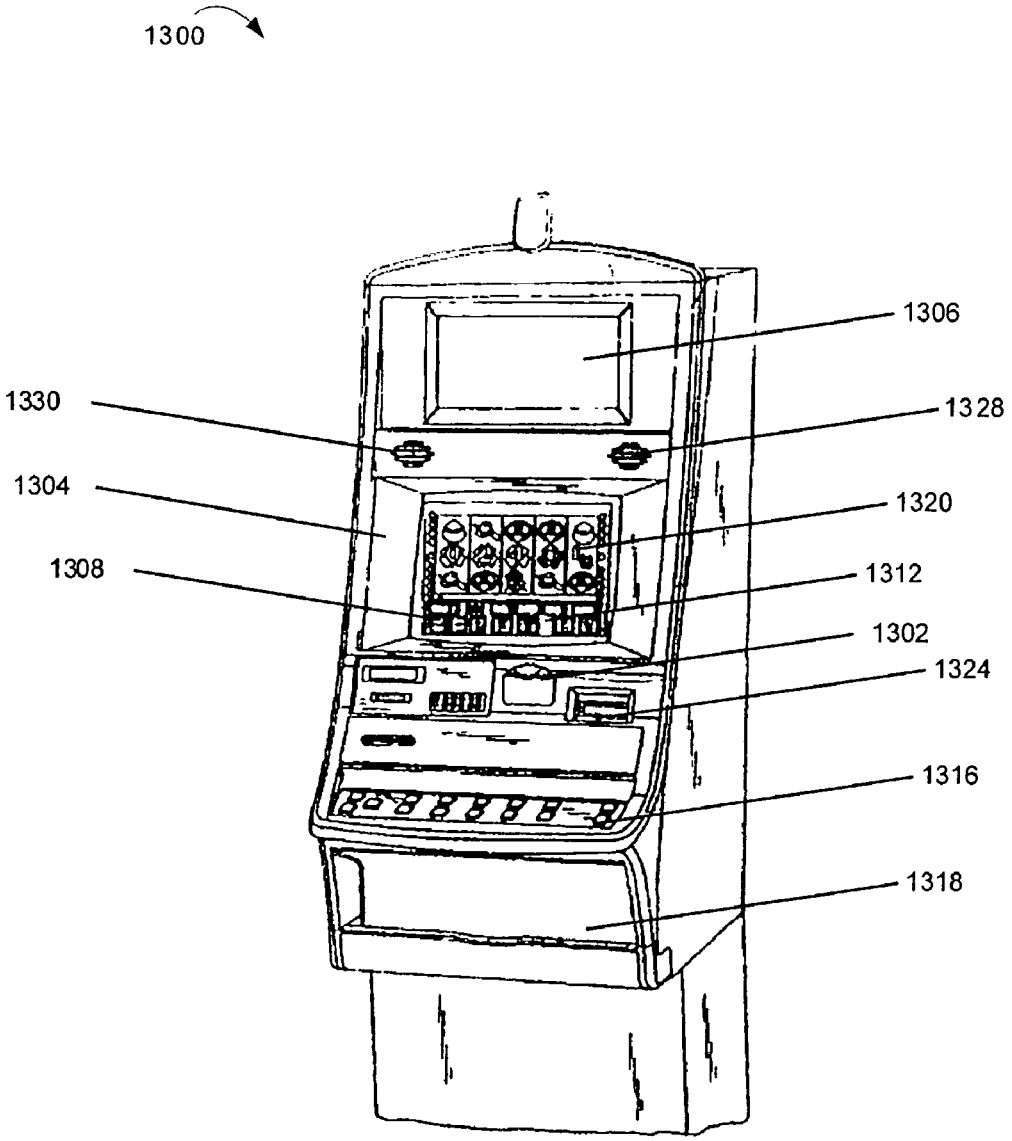
FIG. 13 is a perspective view of a gaming machine used in conjunction with embodiments of the invention.

FIG. 13 is a perspective view of a gaming machine used in conjunction with embodiments of the invention. As shown in FIG. 13, the gaming machine 1300 can be a slot machine having the controls, displays, and features of a conventional slot machine. The gaming machine 1300 can be operated while players are standing or seated. Additionally, the gaming machine 1300 is preferably mounted on a console. However, it should be appreciated that the gaming machine 1300 can be constructed as a pub-style tabletop game (not shown), which a player can operate while sitting. Furthermore, the gaming machine 1300 can be constructed with varying cabinet and display designs. The gaming machine 1300 can incorporate any primary game such as slot, poker, or keno, and additional bonus round games. The symbols and indicia used on and in the gaming machine 1300 can take mechanical, electrical or video form.

As illustrated in FIG. 13, the gaming machine 1300 includes a coin slot 1302 and bill acceptor 1624. Players can place coins in the coin slot 1302 and paper money or ticket vouchers in the bill acceptor 1624. Other devices can be used for accepting payment. For example, credit/debit card readers/validators can be used for accepting payment. Additionally, the gaming machine 1300 can perform electronic funds transfers and financial transfers to procure monies from house financial accounts. When a player inserts money in the gaming machine 1300, a number of credits corresponding to the amount deposited are shown in a credit display. After depositing the appropriate amount of money, a player can begin playing the game by pushing play button 1308. The play button 1308 can be any play activator used by the player to start a game or sequence of events in the gaming machine 1300.

As shown in FIG. 13, the gaming machine 1300 also includes a bet display 1612 and a "bet one" button 1616. The player places a bet by pushing the bet one button 1616. The player can increase the bet by one credit each time the player pushes the bet one button 1616. When the player pushes the bet one button 1616, the number of credits shown in the credit display 1306 decreases by one, and the number of credits shown in the bet display 1612 increases by one.

A player may "cash out" by pressing a cash out button. When a player cashes out, the gaming machine 1300 dispenses a number of coins, corresponding to the number of remaining credits, into the coin tray 1618. The gaming machine 1300 may employ other payout mechanisms such as credit slips, which are redeemable by a cashier, or electronically recordable cards, which track player credits.

The gaming machine 1300 also includes one or more display devices. The embodiment shown in FIG. 13 includes a primary display unit 1304 and a secondary display unit 1306. In one embodiment, the primary display unit 1304 displays a plurality of reels 1620. In one embodiment, the gaming machine displays three reels, while an alternative embodiment displays five reels. In one embodiment, the reels are in video form. According to embodiments of the invention, the display units can display any visual representation or exhibition, including moving physical objects (e.g., mechanical reels and wheels), dynamic lighting, and video images. In one embodiment, each reel 1620 includes a plurality of symbols such as bells, hearts, fruits, numbers, letters, bars or other images, which correspond to a theme associated with the gaming machine 1300. Furthermore, as shown in FIG. 13, the gaming machine 1300 includes a primary sound unit 1628 and a secondary sound unit 1630. In one embodiment, the primary and secondary sound units include speakers or other suitable sound projection devices. The gaming machine 1300 can be adapted to include the system 130. Additionally, the gaming machine 1300 is capable of performing the operations for processing game settings described herein.

The invention claimed is:

1. A gaming machine comprising:

a display object;

a light-guiding panel including opposing front and back surfaces and a panel edge extending between the front and back surfaces, the panel having a uniform refractive index and receiving light emitted into the panel via the panel edge from a light source, the panel including a window, wherein the window is a cutout extending through the front and back surfaces of the light-guiding panel and includes a plurality of cutout edges, and wherein the display object can be viewed through the cutout by a player in front of the gaming machine; and an opaque material covering the plurality of cutout edges, wherein the opaque material impedes the light from entering the window.

2. The gaming machine of claim 1, wherein the opaque material comprises a grommet.

3. The gaming machine of claim 1, wherein the light source is selected from the set consisting of one or more cold cathode fluorescent lamps, one or more incandescent light bulbs, one or more halogen light bulbs, and one or more light emitting diodes.

4. The gaming machine of claim 1, wherein the display object is selected from the set comprising artwork, silkscreen glass, an insertable legend panel, a light emitting diode display device, and a liquid crystal display.

5. The gaming machine of claim 1, wherein the light source can emit the light at varying intensity.

6. A gaming machine comprising:

a display object;

a light-guiding panel having a uniform refractive index and receiving light emitted into the panel from a light source, the panel including a window through which the display object can be viewed by a player in front of the gaming machine, the window including a plurality of window edges; and a lens coupled to at least one of the window edges, wherein the lens focuses some of the light from within the light-guiding panel onto the display object.

7. The gaming machine of claim 6, wherein the light source is selected from the set consisting of one or more cold cathode fluorescent lamps, one or more incandescent light bulbs, one or more halogen light bulbs, and one or more light emitting diodes.

8. The gaming machine of claim 6, wherein the display object is selected from the set comprising artwork, silkscreen glass, an insertable legend panel, a light emitting diode display device, and a liquid crystal display.

9. The gaming machine of claim 6, wherein the light source can emit the light at varying intensity.

10. A gaming machine comprising:

at least one mechanical reel;

a light-guiding panel including opposing front and back surfaces and a panel edge extending between the front and back surfaces, the panel having a uniform refractive index and receiving light emitted into the panel via the panel edge from a light source, the panel including at least one cutout extending through the front and back surfaces of the light-guiding panel, the at least one cutout including a plurality of cutout edges, wherein the at least one mechanical reel can be viewed through the at least one cutout by a player in front of the gaming machine; and opaque material covering the plurality of cutout edges such that the opaque material impedes the light from entering the window.

11. The gaming machine of claim 10, wherein the opaque material comprises a grommet.

12. A gaming machine comprising:

at least one mechanical reel;

a light-guiding panel having a uniform refractive index and receiving light emitted into the panel from a light source, the panel including a window through which the at least one mechanical reel can be viewed by a player in front of the gaming machine, the window including a plurality of window edges; and a lens coupled to at least one of the window edges, wherein the lens directs some of the light from within the light-guiding panel onto the at least one mechanical reel.

* * * * *

UNITED STATES PATENT AND TRADEMARK OFFICE

CERTIFICATE OF CORRECTION

PATENT NO. : 8,282,257 B2
APPLICATION NO. : 11/572879
DATED : October 9, 2012
INVENTOR(S) : James M. Rasmussen It is certified that error appears in the above-identified patent and that said Letters Patent is hereby corrected as shown below:

In column 4, line 29, delete “aback” and insert --a back--, therefor

In column 6, line 22, delete “etc).” and insert --etc.).--, therefor

In column 8, line 15, delete “1624” and insert --1324--, therefor

In column 8, line 17, delete “1624” and insert --1324--, therefor

In column 8, line 32, delete “1612” and insert --1312--, therefor

In column 8, line 32, delete “1616” and insert --1316--, therefor

In column 8, line 33, delete “1616” and insert --1316--, therefor

In column 8, line 35, delete “1616” and insert --1316--, therefor

In column 8, line 36, delete “1616” and insert --1316--, therefor

In column 8, line 38, delete “1612” and insert --1312--, therefor

In column 8, line 42, delete “1618” and insert --1318--, therefor

In column 8, line 50, delete “1620” and insert --1320--, therefor

In column 8, line 57, delete “1620” and insert --1320--, therefor

In column 8, line 61, delete “1628” and insert --1328--, therefor

In column 8, line 62, delete “1630” and insert --1330--, therefor

Signed and Sealed this
Nineteenth Day of March, 2013

Teresa Stanek Rea
*Acting Director of the United States Patent and Trademark Office*